US008723443B2

(12) United States Patent
Deurenberg et al.

(10) Patent No.: US 8,723,443 B2
(45) Date of Patent: May 13, 2014

(54) METHOD OF CONTROLLING AN LED, AND AN LED CONTROLLER

(75) Inventors: Peter Hubertus Franciscus Deurenberg, S-Hertogenbosch (NL); Gert-Jan Koolen, Aarle Rixtel (NL); Gian Hoogzaad, Mook (NL); Radu Surdeanu, Roosbeek (BE); Pascal Bancken, Opwijk (BE); Benoit Bataillou, Lyons (FR); Viet Nguyen Hoang, Leuven (BE)

(73) Assignee: NXP B.V., Eindhoven (NL)

( * ) Notice: Subject to any disclaimer, the term of this patent is extended or adjusted under 35 U.S.C. 154(b) by 273 days.

(21) Appl. No.: 13/257,266

(22) PCT Filed: Feb. 25, 2010

(86) PCT No.: PCT/IB2010/050822

§ 371 (c)(1),
(2), (4) Date: Sep. 16, 2011

(87) PCT Pub. No.: WO2010/106453

PCT Pub. Date: Sep. 23, 2010

(65) Prior Publication Data

US 2012/0001570 A1 Jan. 5, 2012

(30) Foreign Application Priority Data

Mar. 20, 2009 (EP) ..... 09100195

(51) Int. Cl.
*H05B 33/00* (2006.01)

(52) U.S. Cl.
USPC ..... 315/297

(58) Field of Classification Search
CPC ..... H05B 33/0848
USPC ..... 315/297
See application file for complete search history.

(56) References Cited

U.S. PATENT DOCUMENTS 3,550,256 A * 12/1970 Deal ..... 438/454
5,783,909 A 7/1998 Hochstein (Continued)

FOREIGN PATENT DOCUMENTS

WO 0247438 A2 6/2002
WO 2006/043232 A 4/2006
WO WO2006/043232 * 4/2006 ..... H05B 33/08
WO WO 2006/043232 A * 4/2006 ..... H05B 33/0827
WO 2007/090283 A1 8/2007

OTHER PUBLICATIONS

'Diode Characterization by Capacitance-Voltage (CV) Measurements', ELEE 4119 Solid State Devices Laboratory, Jul. 7, 2004.*
International Search Report for Int'l Patent Application No. PCT/IB2010/050822 (Apr. 14, 2010).

*Primary Examiner* — Jason M Crawford
*Assistant Examiner* — Christine Johnson

(57) ABSTRACT

A method is disclosed of controlling a LED, comprising driving the LED with a DC current for a first time, interrupting the DC current for a second time such that the first time and the second time sum to a period, determining at least one characteristic of the LED while the DC current is interrupted, and controlling the DC current during a subsequent period in dependence on the at least one characteristic. The invention thus benefits from the simplicity of DC operation. By operating at the LED in a DC mode, rather than say in a PWM mode, the requirement to be able to adjust the duty cycle is avoided. By including interruptions to the DC current, it is possible to utilize the LED itself to act as a sensor in order to determine a characteristic of the LED. The need for additional sensors is thereby avoided.

14 Claims, 7 Drawing Sheets

(56) References Cited

U.S. PATENT DOCUMENTS

| | | | | |
|---|---|---|---|---|
| 6,016,038 | A | 1/2000 | Mueller et al. | |
| 6,127,783 | A | 10/2000 | Pashley et al. | |
| 6,441,558 | B1 | 8/2002 | Muthu | |
| 2005/0062481 | A1* | 3/2005 | Vaughn et al. | 324/500 |
| 2007/0040512 | A1 | 2/2007 | Jungwirth et al. | |
| 2008/0084169 | A1* | 4/2008 | Wendt et al. | 315/297 |
| 2008/0290804 | A1 | 11/2008 | Santo et al. | |

* cited by examiner

METHOD OF CONTROLLING AN LED, AND AN LED CONTROLLER

FIELD OF THE INVENTION

This invention relates to a method of driving an LED. It further relates to LED drivers. The driver may be for a multicoloured array of LEDs.

BACKGROUND OF THE INVENTION

LEDs, particularly for the LED lighting industry, are conventionally driven by pulse width modulation (PWM). In PWM, the LED is modulated between an on state and an off state. When in the on state, typically the LED is supplied with a constant current. When in the off state, there is no current is supplied to the LED. The output flux, that is to say the amount of light output by the LED is determined by the time-integral of the current. So by varying the pulse width, while keeping the current in the on state constant, the optical output of the LED can be varied without changing the instantaneous current through the LED.

This is important because the wavelength of the LED can have a strong current dependency. The wavelength can decrease by up to 30 nm/A. Maintaining a constant wavelength of the optical output from the LED can be useful for a single colour LED; however, it is of particular importance for multicoloured LED arrays. Typically in such multicoloured arrays, the outputs of three sets of LEDs having different colours are combined. The apparent colour of the combined array is then dependent on both the ratio of the intensities of the three sets of the LEDs, and on their absolute wavelengths. When the three sets of LEDs are combined to produce white light, it is particularly important to be able to control or maintain the wavelengths of the component LEDs, in order to have accurate control over the "combined colour temperature" (CCT) of the output.

Although PWM has heretofore been the preferred control method particularly for multicolour arrays of LEDs, it still suffers from the disadvantage that both the flux output and the colour of the individual LEDs is still temperature dependent; without compensation, a visible effect on the output can be observed for a temperature difference of merely 20° C.

Using the LED itself to determine the temperature of the LED has been disclosed in international patent application, publication WO-A-2007/090283. This is used to estimate the colour of the LED, whereas the duty cycle of the control is adjusted to control the output flux of the LED.

SUMMARY OF THE INVENTION

It is an object of the present invention to provide a simple and effective method of controlling an LED. It is a further object to provide a controller for an LED or a controller for only a multicolour LED array.

According to the present invention there is provided a method of controlling a LED, comprising driving the LED with a DC current for a first time, interrupting the DC current for a second time such that the first time and the second time sum to a period, determining at least one characteristic of the LED whilst the DC current is interrupted, and controlling the DC current during a subsequent period in dependence on the at least one characteristic. The invention thus benefits from the simplicity of DC operation. By operating at the LED in a DC mode, rather than say in a PWM mode, the requirement to be able to adjust the duty cycle is avoided. By including interruptions to the DC current, it is possible to utilise the LED itself to act as a sensor in order to determine a characteristic of the LED. The need for additional sensors is thereby avoided.

In a preferred embodiment, each of the first time and the second time is constant. More preferably, the ratio of the first time to the second time is at least 99. In contrast to PWM control of wherein the duty cycle is likely to vary significantly, according to this embodiment the instantaneous current through the LED can thereby be kept to a minimum. Since the efficiency of LEDs typically is higher for lower drive currents, this can improve the overall system performance.

In preferred embodiments, the LED is driven into forward bias whilst the DC current is interrupted. Driving the LED into forward bias during interruption facilitates carrying out measurements on the LED during the interruption. Typically, the forward bias results in a forward current which is less than 100 μA, and moreover the forward bias may result in a forward current which is less than 10 μA. Since the operational forward current can be 10s of mA, the forward current during the interruption is thus 2 or 3 orders of magnitude lower than that during the first, operational, time. Utilising such low forward currents during interruption prevents self heating effects and minimises the power consumption of the diode.

In embodiments the at least one characteristic comprises the LED temperature. The LED may be driven into forward bias during the interruption by means of a second constant current, an operating bias across the LED may measured during the first time, and the LED temperature may determined in dependence on the forward bias and the operating bias. Furthermore, the LED temperature may be determined by comparing an average value of the forward bias and an average value of the operating bias with predetermined values in a look-up table. Thus, the LED itself may be able to be utilised as a temperature sensor, which results in the cost saving relative to case in which a separate temperature sensor is required.

In other embodiments, the at least one characteristic comprises the LED wavelength. In particular, the LED wavelength may be determined by measuring a CV response of the LED during the second time. Further, a phase may be derived from the CV response, and the LED wavelength determined from the phase. Thus beneficially it can be possible to determine the wavelength or a measure of the wavelength, without the requirement for a separate wavelength sensor.

In a yet further embodiment, the at least one characteristic comprises the output flux. Thus the output flux can, according to embodiments of the invention, be determined without the need for a separate photodiode or other sensor. The output flux may be determined by measuring a CV response of the LED during the second time, and in embodiments, this may be achieved by measuring the sharpness of a negative maximum in the CV response plotted as a capacitance-voltage plot.

It will be immediately apparent that in embodiments more than one of, or any combination of, flux, temperature and wavelength may be determined. Further, the invention is not limited to these characteristics; other useful characteristics which can be determined during the interruption will be immediately apparent to the skilled person.

According to another aspect of the present invention there is provided a controller for an LED configured to operate according to any of the methods just described.

According to a yet further aspect of the present invention there is provided a controller for a multicoloured array of LEDs, configured to operate according to any of the methods just described These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

Figure 1:
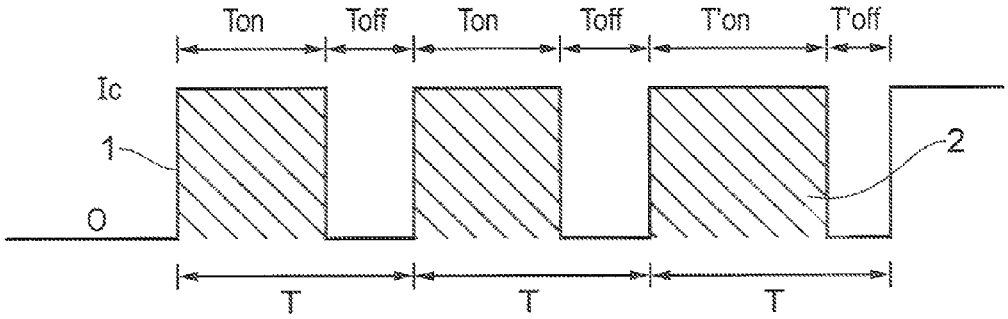
FIG. 1 illustrates the drive current for a conventionally PWM controlled LED.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments

DETAILED DESCRIPTION OF EMBODIMENTS

FIG. 1 shows an LED drive current signal, for a conventional, PWM controller. In an on state the control provides a current $I_C$ to the LED (or string of LEDs if the control is controlling a plurality of LEDs). The period T of the modulation is constant. The control is on for a period of Ton and off for a period Toff. Neglecting LED self-heating effects, the LED optical flux output corresponds to the integral of the current, that is, to the area 1 underneath the Ton the part of the cycle. In order to increase the optical flux of the LEDs, the duty cycle is varied; that is to say the ratio Ton:Toff is increased. This is shown on the right-hand side of diagram, where Ton'>Ton, and Toff'<Toff, so that the flux corresponding to area 2 is increased relative to the flux corresponding to area 1, but the period T remains constant.

Figure 3:
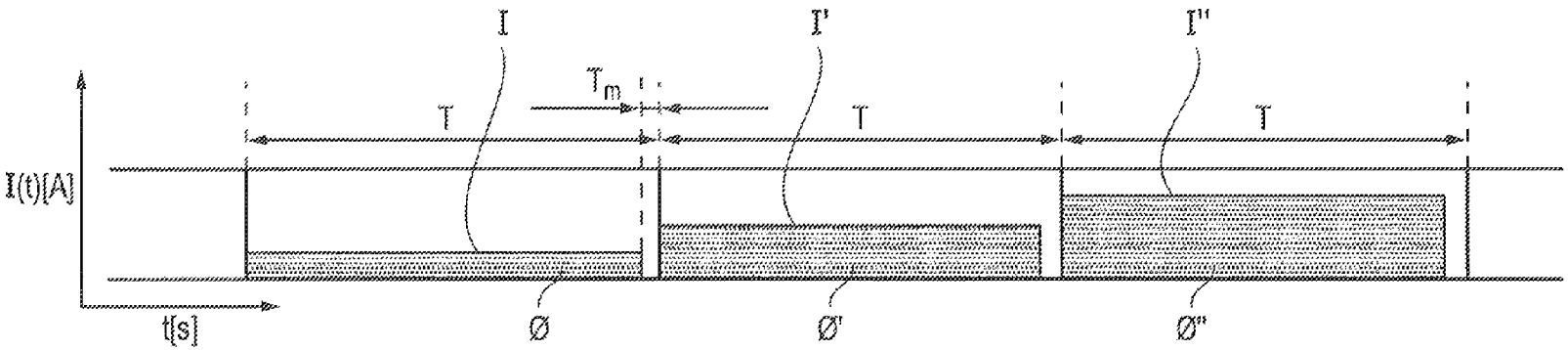
FIG. 3 illustrates the drive current for a DC controlled LED, including interruptions, according to embodiments of the invention.

In contrast, an example of a DC modulated current, for driving an LED, according to embodiments of the present invention is shown in FIG. 3. This figure shows the variation of the driver current (I) with time (t). The period for the control is constant, at T, and is split into two parts: during the first part of the period current is applied to the LEDs; during the second part of the period, shown at Tm, the current is interrupted. In other words, the interruptions occur at a fixed frequency and have a fixed duration, unlike the PWM control system in which the interruptions have a varying duration which depends on the duty cycle. The interruptions can be very short, and typically last less than 10 μs for a control operating with a 1 kHz frequency and thus a time period T of 1 ms, so as not to significantly reduce the maximum output of the system. Equally, the driver could operate at a lower frequency of say 100 Hz, and have interruptions which are of the order of, or less than 100 μs. In both these examples, the duty cycle of the driver would remain constant is that 99%. However, this is not a limiting value, and a lower duty cycle such as 95% may be acceptable if it is required that the interruptions need to be longer, in order to properly determine the characteristic of the LED, as will be discussed in more detail herebelow.

Figure 2:
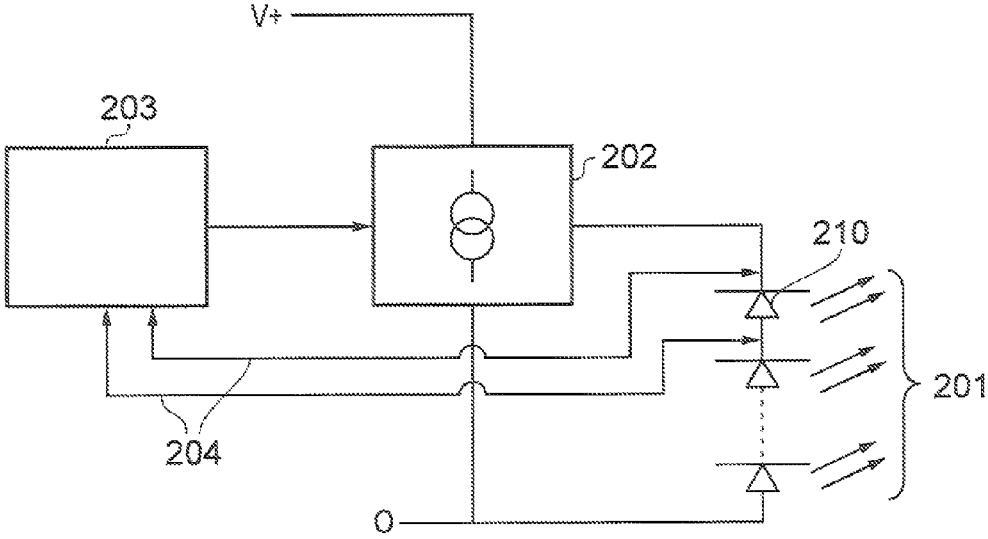
FIG. 2 shows a schematic of a drive circuit arranged according to embodiments of the invention.

A controller for an LED, configured to operate according to an embodiment the invention is shown in FIG. 2. An LED or LED string 201 is connected in series with an LED driver 202. The LED driver 202 is arranged to act as a current source. The LED driver 202 is capable of providing a constant current, typically of the order of 10 to 50 mA. It is also capable of providing a constant current, corresponding to a low forward bias for the LEDs: this second constant current typically use in the range of 1 to 50 μA, and is supplied during the interruption to the DC current output discussed above with reference to FIG. 3. The driver is typically supplied by a DC voltage V+. The LED driver 202 is controlled by means of controller 203. The controller 203 senses the voltage drop across LED 210. The sensing may be carried out by means of Kelvin probes 204. (Kelvin probes are ones which carry almost no current and thus are not susceptible to Ohmic losses.) In addition to supplying the low level forward current, driver 202 is also adapted to supply a high frequency AC signal on top of the low level forward current, in order to facilitate CV measurements which are discussed in more detail herebelow.

The current provided by the driver is a direct current, and constant within any individual period (apart from being subject to the interruption as discussed above). However, the DC current can be modulated; during a subsequent period, the current I' may be a higher than the current I. FIG. 3 shows three such periods, with increasing currents I, I' prime and I", during three successive periods. The optical flux output for each period increases along with the integral of the drive current, which corresponds to the areas Ø, Ø' and Ø" respectively, under the curves during the time that the DC current is applied. In other words the optical flux from the LEDs will increase from Ø to Ø' to Ø". It is important to note that this control methods is not the same as PWM control, since the duty cycle remains fixed and is relatively high. Since the duty cycle is very close to 1, the average current is very close to the instantaneous current. The efficiency of the LEDs can thereby be maximised, since typically LEDs have an efficiency which is higher for a lower drive current.

Providing an interruption to the driver currents during the time Tm allows for measurements to be made directly on the LED whilst it is in a quiescent state. For some measurements, as will be described in more detail herebelow, it is useful to drive of the LED at a low forward bias. Since the low forward bias typically results in a forward current which is of the order of 100 or even 1000 times lower than that of the driver currents, this is not shown in FIG. 3.

Whilst the drive current is interrupted, the LED can operate as a sensor. Using the LED itself as a sensor has several advantages. Firstly and most evidently, the requirement for additional, separate sensors is avoided. Secondly, there is a resulting cost saving, and space-saving as well as a decrease in circuit complexity because, for instance, it may possible to integrate the driver IC. Thirdly, it is particularly convenient to use the LED itself for measuring the LED junction temperature, since the temperature is determined exactly at the LED, rather than merely in some other position as would be the case were an separate temperature sensor used.

Figures 4A, 4B:
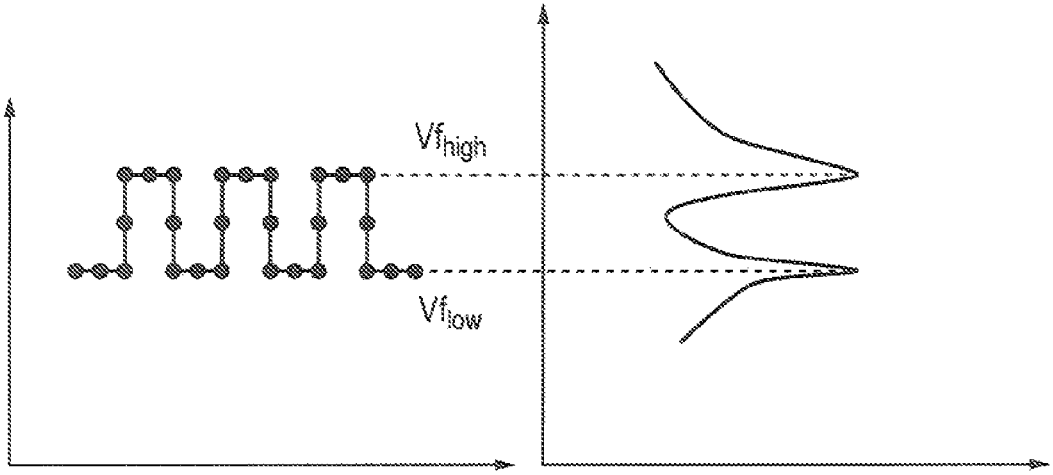
FIGS. 4(*a*), (*b*) and (*c*) show respectively forward bias measurements at operational current bands that load currents, the histogram of such measurements, and is the temperature dependence of the low forward voltage, for and LED operated according to embodiment of the invention.
Figure 4C:
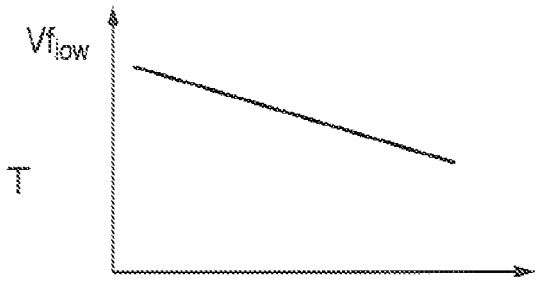

A novel method of determining the LED junction temperature, using voltage measurements made during the interruptions, and whilst the controller is supplying the DC current, will now be described with reference to FIG. 4. At FIG. 4(*a*) is shown measurements of the forward bias voltage across the LED, both when the LED is being driven by the DC current ($Vf_{high}$), and when in forward bias during the interruptions ($Vf_{low}$). The x-axis represents time, and the figure is clearly not to scale. By averaging the measurements over time, a histogram of the Voltage across the diode, both when driven with the DC current, and when being biased during the interruptions, can be established. This is shown at FIG. 4(*b*). The histogram has two peaks, corresponding to the forward bias during normal operation, and the forward bias (or forward voltage) resulting from the low current during the interruptions; the measurements away from the peaks—which result from thermal noise, etc—can thus be averaged out.

As shown in FIG. 4(*c*), the forward bias corresponding to a specific current varies inversely with temperature. The nature of this variation, for any specific diode type, can be predetermined, and stored for example in a look-up table. From the measured value, or the average value—which may be determined by means of the histogram as shown or by any other convenient means, as will be known to the skilled person—the temperature of the LED junction can thus be determined.

Figure 5:
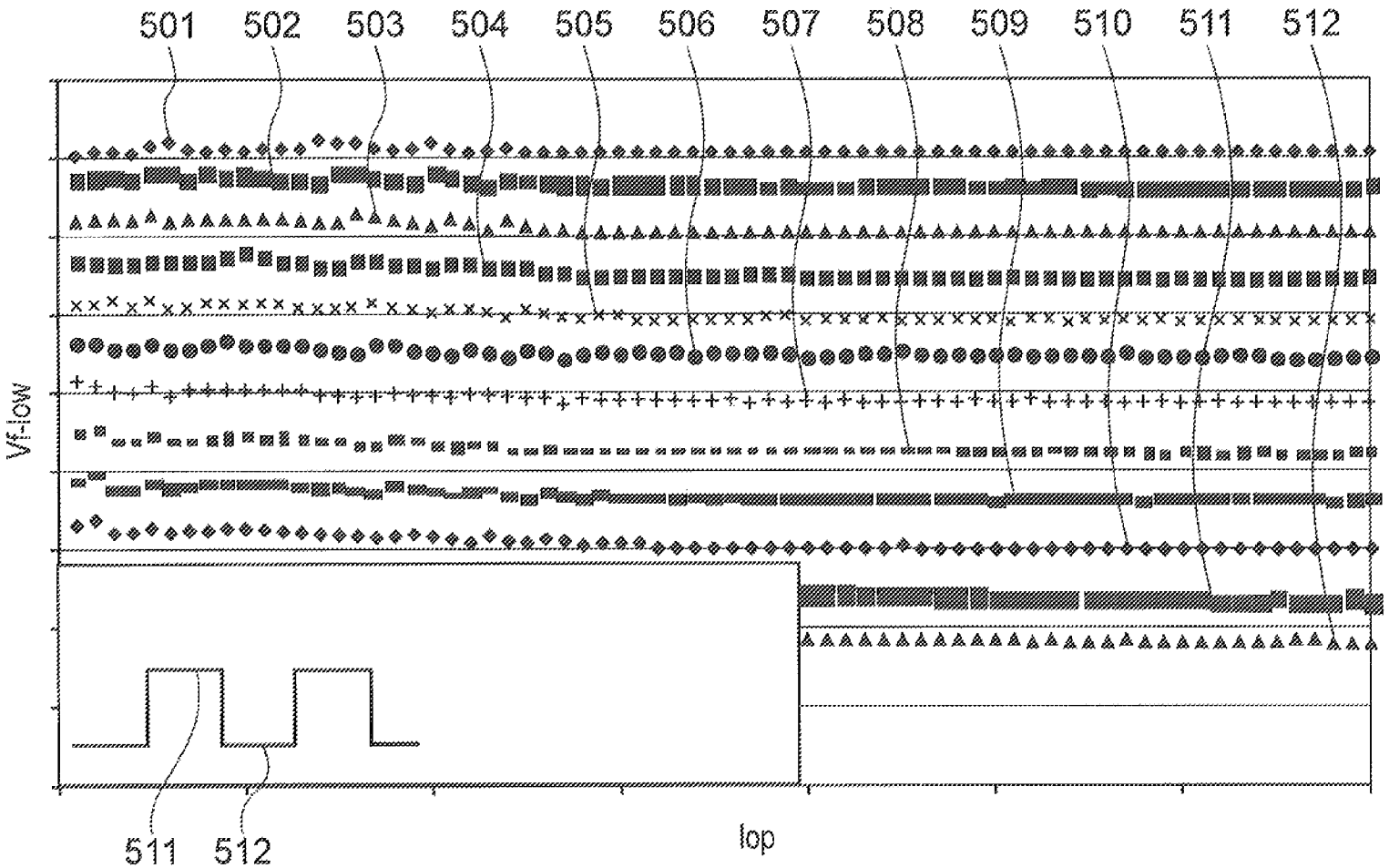
FIG. 5 shows experimental measurements of the temperature dependence of forward low voltage, for an LED driven according to embodiments of the invention.

FIG. 5 shows an experimental result, demonstrating the variation of the forward bias with temperature. The current is cycled between an operational current level 511, and a low current level 512 of 10 μA, with a frequency of 500 Hz. In the figure, the forward voltage at low current, Vf-low, is plotted against operational current (Iop), for a sample LED, at various temperatures. The operational current, on the abscissa, ranges from 0 to 70 mA. The forward voltage ordinate is shown between 1.32 and 1.5 V. The data shown as plots 501 to 512 respectively correspond to die temperatures ranging from 25° C. to 80° C., in 5° C. intervals. It is clear that the forward voltage at low current, Vf-low, is essentially independent of the operational current.

A further characteristic of the LED which may be determined during the interruption, whilst the drive current is not being supplied to the LED, is the wavelength of the generated light. One example method of determining this will now be described.

LED are normally fabricated as a double hetero-structure, or multiple quantum wells structure, where a lattice mismatch is always present between different layers and with the substrate. Due to this mismatch, defects are introduced in the structure, which results in the presence of interface states. Since the manufacturing process of the double hetero-structure can never be perfectly controlled, LEDs from the same batch will have slight different density of interface traps, and as a result, slightly different wavelength. On top of that, clustering of the Indium in the alloys (for blue and green LEDs AlInGaN and red LEDs AlInGaP structures) leads to formation of quantum dots of various sizes, with interface states also at the interface between the GaN or GaP layers and these Indium quantum dots.

Figure 6:
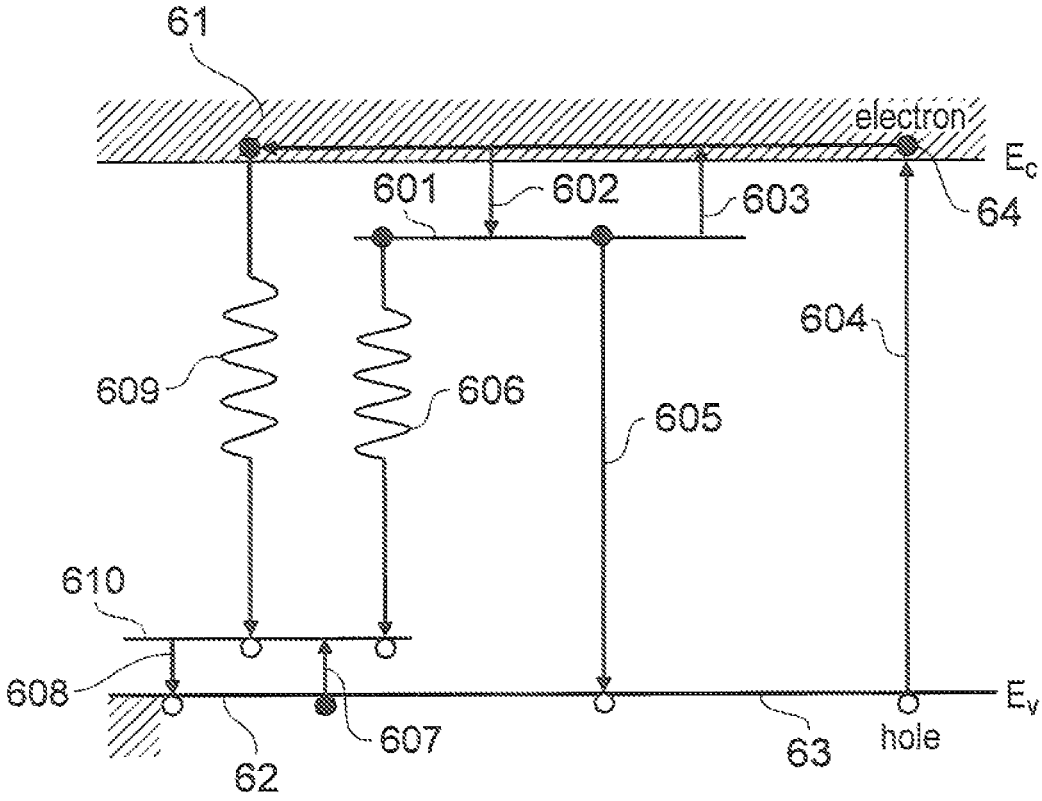
FIG. 6 shows a band diagram showing of errors transition is available within an LED.

FIG. 6 illustrates, on a band diagram, the various transitions which can occur between the conduction band 61 and the valence band 62. One transition 604 is the direct promotion of an election 64 from the valence band 62 to the conduction band 61. Shallow traps 601 near the conduction band can provide for two-stage transitions back to the valence band: first transitions 602 from the conduction band to the trap may be followed by a non-radiative transition 605 from the trap 601 back to the valence band. Alternatively the electron may be promoted back from the trap 601 to the conduction band 61. Furthermore, there may be luminescent centres 610 near to the valence band 62. Elections may be promoted 607 from the valence band to the luminescent centres, and return via transition 608. Finally, and most importantly for operation of the LED, there can be radiative transitions 609 and 606 from the conduction band 61 and the shallow traps 601 to the luminescent centres 610. The interface states described above can create more shallow traps states; therefore more non-radiative transitions are possible. Conversely, the quantum dots can create more shallow radiative states from which can lead to more radiative transitions.

Figure 7:
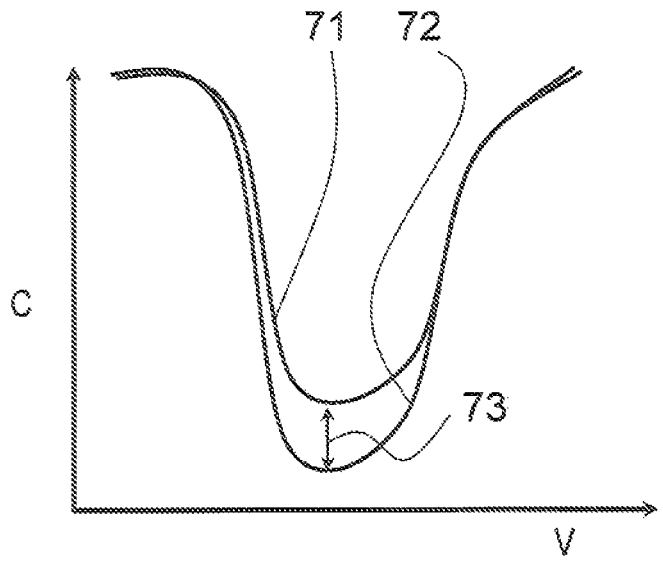
FIG. 7 shows the schematically CV plots for similar MOS transistors with two differing gate oxides.

Capacitance-voltage (CV) measurements are routine measurement made on, for example, CMOS devices (to determine the thickness and quality of the gate oxide, or p-n junctions. FIG. 7 shows schematically two CV measurements 71 and 72 made on two different oxide gates in a MOS transistor. The difference 73 between the minima of the two curves is due to difference in the presence of interface states. Since the interface states result in non-radiative transitions, an increase in the density of interface results in a relative decrease in radiative transitions, correspondence to a similar decrease in luminous flux. The shape of the CV curve, and in particular the sharpness of the negative peak in the CV response, thus acts as a measure of the luminous flux of the LED. Similarly, FIG. 82 shows the phase (ϕ) voltage (V) relationship for the same devices depicted in FIG. 7. Once again the difference 83 between the two curves 81 and 82 corresponds to the difference in the density of interface traps or, for a direct band-gap potentially radiative device, luminous centres By measuring Capacitance and Voltage directly on an LED, the difference in the Capacitance value at the bottom of the curves can be related to the interface states present at the junction interface, which for LEDs is correlated to the wavelength. Also, this difference can give information on the density of luminous centres, and therefore, on the luminous flux of the LED.

Figure 8:
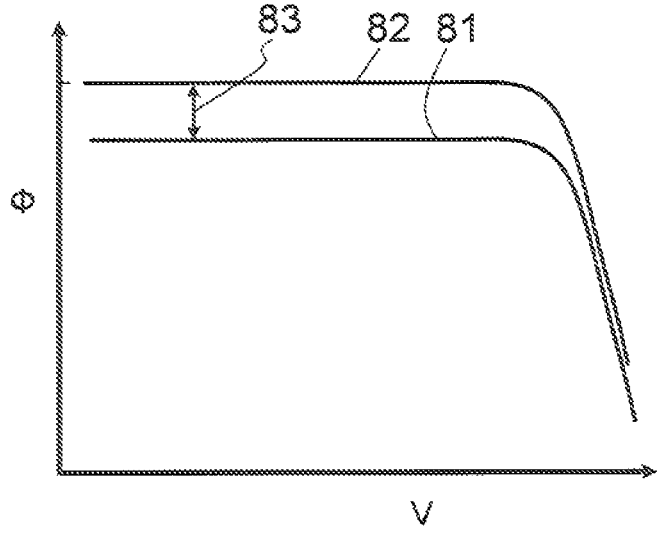
FIG. 8 shows the phase angle plot against Voltage corresponding to the CV plot shown in FIG. 7.
Figure 9:
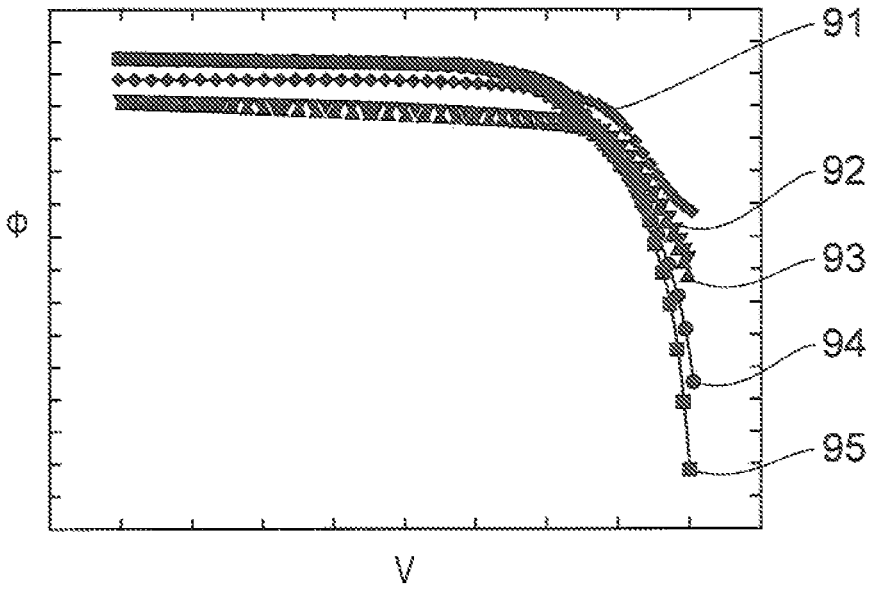
FIG. 9 shows corresponding phase angle plots for several blue LEDs.

Experimental phase voltage plots for five LEDs are shown in FIG. 9. Similarly to FIG. 8, the phase ϕ is plotted against voltage V. Plots 91 through 95 show the response of five different blue LEDs. In each case the measurement is made at 1 MHz.

Figure 10:
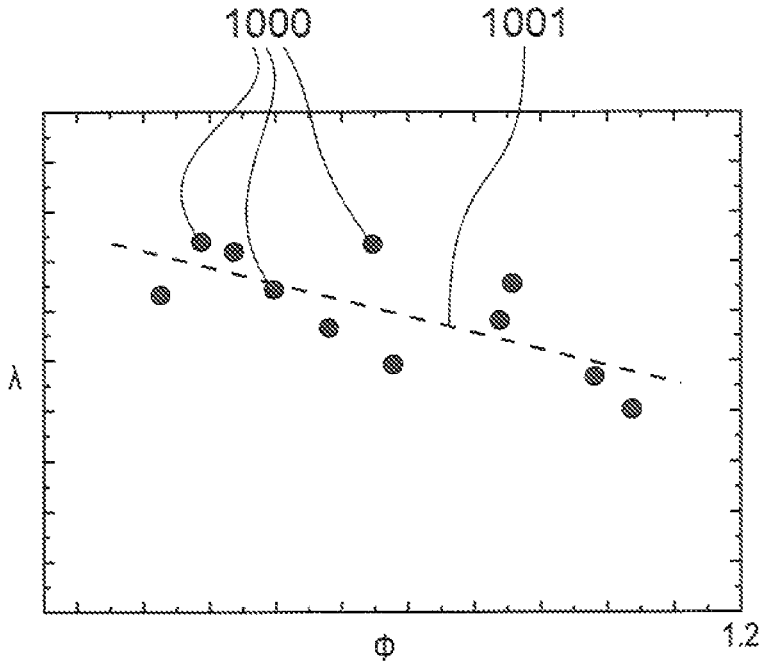
FIG. 10 shows the correlation between phase angle and peak wavelength for a group of blue LEDs.

FIG. 10 shows the correlation between the peak wavelength λ of a group of blue LEDs and the low-voltage phase ϕ. The ordinate shows a wavelength range from 466-471 nm, and the abscissa has a phase range of 90.02° to 91.2°. In each case the peak wavelength was measured at a forward current of 30 milliamps, and the CV curve measured at 1 MHz. The points 1000 corresponding to each individual LED clearly show a correlation, the trend from which is plotted on-line 1001.

As has already been briefly referred to, the CV plots can also be used to determine the density of the luminescent centres in the LED. Since this is directly related to see the luminous flux from the LED, three measurements can be used to determine a measure of the luminous flux: by the CV measurements, the density of interface states, which correlates to the density of shallow trap states, can be determined or quantified. Using this measurement, and compared to a first calibration measurement, the variation in the shallow trap states indicates the variation in the non-radiative transitions, thus the inverse variation in radiative transitions resulting in luminous flux). Thus, the sharpness of the negative maximum in a plot of capacitance versus voltage, as measured by known CV measuring techniques, during the interruption time, which time may equally be termed the interruption period or interruption interval or interruption duration, can be used to provide a determination of the luminous flux of the LED.

From reading the present disclosure, other variations and modifications will be apparent to the skilled person. Such variations and modifications may involve equivalent and other features which are already known in the art of LED drivers and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A method of controlling a LED, comprising driving the LED with a DC current for a first time, interrupting the DC current for a second time such that the first time and the second time sum to a period, measuring a CV response of the LED during the second time, determining at least one of an output flux and a wavelength of the LED whilst the DC current is interrupted, and controlling the DC current during a subsequent period in dependence on the respective output flux or wavelength of the LED.

2. The method of claim 1, wherein each of the first time and the second time is constant.

3. The method of claim 2, wherein the ratio of the first time to the second time is at least 99.

4. The method of claim 1, wherein the LED is driven into forward bias whilst the DC current is interrupted.

5. The method of claim 4, wherein the forward bias results in a forward current which is less than 100 μA.

6. The method of claim 4, wherein the forward bias results in a forward current which is less than 10 μA.

7. The method of claim 1, wherein a phase is derived from the CV response, and the LED wavelength determined from the phase.

8. The method of claim 1, wherein the output flux is determined from the sharpness of a negative maximum in the CV response plotted as a capacitance-voltage plot.

9. A controller for an LED configured to operate by a method according to any preceding claim.

10. A controller for a multicolored array of LEDs, configure to operate by a method according to claim 1.

11. A method of controlling a LED, comprising driving the LED with a DC current for a first time, interrupting the DC current for a second time such that the first time and the second time sum to a period, measuring a CV response of the LED during the second time, determining at least one of an output flux and a wavelength of the LED whilst the DC current is interrupted, controlling the DC current during a subsequent period in dependence on the respective output flux or wavelength of the LED, and driving the LED into forward bias whilst the DC current is interrupted.

12. The method of claim 11, wherein the step of driving the forward bias including driving a forward current which is less than 100 μA.

13. The method of claim 11, wherein the step of driving the forward bias including driving a forward current which is less than 10 μA.

14. The method of claim 11, further including deriving a phase from the CV response, and determining the LED wavelength based on the step of deriving the phase.

* * * * *